US011806289B2

(12) United States Patent
Moore et al.

(10) Patent No.: US 11,806,289 B2
(45) Date of Patent: Nov. 7, 2023

(54) EXOSKELETON WHEELCHAIR SYSTEM

(71) Applicant: Toyota Motor Engineering & Manufacturing North America, Inc., Plano, TX (US)

(72) Inventors: Douglas Moore, Livermore, CA (US); Christopher Paul Lee, Newark, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 196 days.

(21) Appl. No.: 17/373,994

(22) Filed: Jul. 13, 2021

(65) Prior Publication Data

US 2021/0338502 A1 Nov. 4, 2021

Related U.S. Application Data

(62) Division of application No. 15/423,780, filed on Feb. 3, 2017, now Pat. No. 11,096,847.

(51) Int. Cl.
*A61G 5/14* (2006.01)
*A61H 3/04* (2006.01)
(Continued)

(52) U.S. Cl.
CPC ..... *A61G 5/14* (2013.01); *A61G 5/04* (2013.01); *A61G 5/127* (2016.11); *A61G 5/128* (2016.11); *A61H 1/024* (2013.01); *A61H 1/0237* (2013.01); *A61H 1/0262* (2013.01); *A61H 1/0266* (2013.01); *A61H 3/00* (2013.01); *A61H 3/04* (2013.01); *A61G 5/1067* (2013.01); *A61G 5/121* (2016.11); *A61G 5/122* (2016.11);
(Continued)

(58) Field of Classification Search
CPC ..... A61G 5/04; A61G 5/14
See application file for complete search history.

(56) References Cited

U.S. PATENT DOCUMENTS 3,574,399 A 4/1971 Udden
8,403,352 B2 3/2013 Hunziker
(Continued)

FOREIGN PATENT DOCUMENTS

EP 2127625 B1 1/2014
TW 201304760 A 2/2013
WO 2008041959 A2 4/2008

OTHER PUBLICATIONS

"XO-202 Standing Wheelchair Stand Power Drive" Aug. 17, 2016, URL: https://www.karmanhealthcare.com/product/xo-202/.

*Primary Examiner* — Jacqueline Woznicki
(74) *Attorney, Agent, or Firm* — Dinsmore & Shohl LLP

(57) ABSTRACT

An exoskeleton wheelchair system includes a base, one or more wheels coupled to the base, a body support connected to the base comprising: a back support; and one or more leg supports pivotally coupled to the back support, and a gait wheel linked with the one or more leg supports via one or more gait linkages and configured to rotate the one or more leg supports. The one or more leg supports are configured to pivot about a first axis when the back support is in a standing position mode. The back support is maintained at a fixed position relative to a location of the base when the one or more leg supports pivot about the first axis while the back support is in the standing position mode.

6 Claims, 11 Drawing Sheets

(51) Int. Cl.

| | |
|---|---|
| ***A61H 3/00*** | (2006.01) |
| ***A61G 5/12*** | (2006.01) |
| ***A61G 5/04*** | (2013.01) |
| ***A61H 1/02*** | (2006.01) |
| *A61G 5/10* | (2006.01) |

(52) U.S. Cl.

CPC ..... *A61G 5/125* (2016.11); *A61H 2003/043* (2013.01); *A61H 2201/0173* (2013.01); *A61H 2201/1215* (2013.01); *A61H 2201/1269* (2013.01); *A61H 2201/164* (2013.01); *A61H 2201/1623* (2013.01); *A61H 2201/1671* (2013.01); *A61H 2201/1676* (2013.01); *A61H 2201/5007* (2013.01); *A61H 2201/5023* (2013.01); *A61H 2201/5025* (2013.01); *A61H 2205/10* (2013.01); *A61H 2205/102* (2013.01)

(56) References Cited

U.S. PATENT DOCUMENTS 8,801,641 B2 * 8/2014 Kazerooni ..... A61H 1/0244 601/5
2010/0095453 A1 4/2010 Lin et al.
2010/0288575 A1 11/2010 Irvine
2012/0133113 A1 5/2012 Takamoto et al.
2013/0020779 A1 1/2013 Green et al.
2013/0113178 A1 5/2013 Goldish et al.
2013/0134757 A1 5/2013 Hines
2014/0100493 A1 * 4/2014 Craig ..... B25J 9/0006 601/35
2014/0138995 A1 5/2014 Leib
2014/0191541 A1 7/2014 Ohta et al.
2015/0018177 A1 1/2015 Oblak et al.
2015/0060162 A1 3/2015 Goffer
2015/0075575 A1 * 3/2015 Karlovich ..... A61N 1/0452 135/65
2015/0084307 A1 3/2015 Goldish et al.
2015/0283009 A1 * 10/2015 Borisoff ..... A61H 1/0262 280/47.41
2015/0297439 A1 * 10/2015 Karlovich ..... A61H 3/008 280/647
2016/0128890 A1 * 5/2016 LaChappelle ..... A61H 3/00 623/30
2016/0166454 A1 * 6/2016 Johnson ..... A61H 3/008 280/1.5
2017/0055713 A1 3/2017 Ravn
2017/0128291 A1 5/2017 Kim
2018/0110664 A1 4/2018 Borisoff et al.

* cited by examiner

EXOSKELETON WHEELCHAIR SYSTEM

CROSS REFERENCE TO RELATED APPLICATION

This application is a divisional application of U.S. patent application Ser. No. 15/423,780, filed on Feb. 3, 2017, the entire contents of which are herein incorporated by reference.

TECHNICAL FIELD

The present specification generally relates to exoskeleton wheelchair systems and, more specifically, to exoskeleton wheelchair systems that pivot leg supports of the wheelchair systems to improve blood flow in legs of a wheelchair user.

BACKGROUND

When a person sits on a wheelchair for a long period of time, she may have poor blood flow in her legs due to consistent pressure on her legs.

Accordingly, a need exists for wheelchair systems that mitigate the poor blood flow in patient's legs.

SUMMARY

In one embodiment, an exoskeleton wheelchair system includes a base, one or more wheels coupled to the base, a body support connected to the base. The body support includes a back support, and one or more leg supports pivotally coupled to the back support. The exoskeleton wheelchair system also includes an actuator linked with the one or more leg supports via one or more linkages and configured to rotate the one or more leg supports, a processor, a memory module, and machine readable instructions stored in the memory module that, when executed by the processor, cause the processor to rotate the one or more leg supports with the actuator. The one or more leg supports are configured to pivot about a first axis when the back support is in a standing position mode, and the first axis is maintained at a fixed position relative to a location of the base when the one or more leg supports pivot about the first axis while the back support is in the standing position mode.

In another embodiment, an exoskeleton wheelchair device includes a base, one or more wheels coupled to the base, and a body support connected to the base. The body support includes a back support, and one or more leg supports pivotally coupled to the back support. The one or more leg supports are configured to pivot about a first axis when the back support is in a standing position mode, and the first axis is maintained at a fixed position relative to a location of the base when the one or more leg supports pivot about the first axis while the back support is in the standing position mode.

In yet another embodiment, an exoskeleton wheelchair system includes a base, one or more wheels coupled to the base, a body support connected to the base. The body support includes a back support, and one or more leg supports pivotally coupled to the back support. The exoskeleton wheelchair system also includes a gait wheel linked with the one or more leg supports via one or more gait linkages and configured to rotate the one or more leg supports. The one or more leg supports are configured to pivot about a first axis when the back support is in a standing position mode, and the back support is maintained at a fixed position relative to a location of the base when the one or more leg supports pivot about the first axis while the back support is in the standing position mode.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 2A:
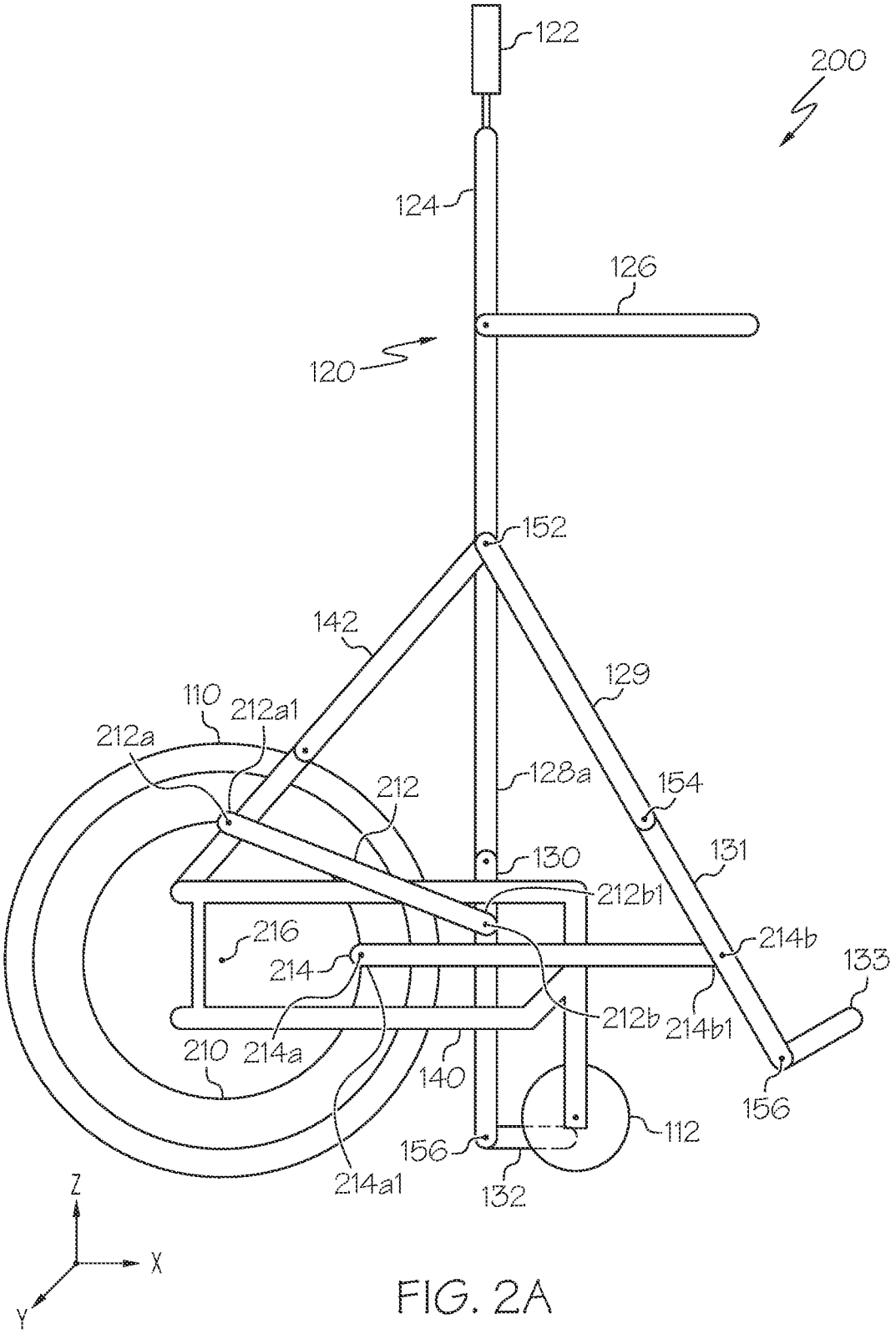
FIG. 2A schematically depicts an exoskeleton wheelchair system in a standing position mode in accordance with one or more embodiments shown and described herein.

The embodiments disclosed herein include exoskeleton wheelchair systems including pivoting leg supports. Referring generally to FIG. 2A, an exoskeleton wheelchair system includes a base, one or more wheels coupled to the base, a body support connected to the base. The body support includes a back support, and one or more leg supports pivotally coupled to the back support. The exoskeleton wheelchair system also includes an actuator linked with the one or more leg supports via one or more linkages and configured to rotate the one or more leg supports, a processor, a memory module, and machine readable instructions stored in the memory module that, when executed by the processor, cause the processor to rotate the one or more leg supports with the actuator. The one or more leg supports are configured to pivot about a first axis when the back support is in a standing position mode, and the first axis is maintained at a fixed position relative to a location of the base when the one or more leg supports pivot about the first axis while the back support is in the standing position mode. By allowing the one or more leg supports to pivot while in the standing position mode, a user sitting in the exoskeleton wheelchair system can move his legs even when his legs are disabled, which improves blood flow in the legs. In addition, the exoskeleton wheelchair system may help the user sitting in the exoskeleton wheelchair system to learn how to walk on the ground naturally.

As used herein, the term "longitudinal direction" refers to the forward-rearward direction of the exoskeleton wheelchair system (i.e., in the +/−X-direction of the coordinate axes depicted in the figures). The term "lateral direction" refers to the cross-wise direction of the exoskeleton wheelchair system (i.e., in the +/−Y-direction of the coordinate axes depicted in the figures), and is transverse to the longitudinal direction. The term "vertical direction" refers to the upward-downward direction of the exoskeleton wheelchair system (i.e., in the +/−Z-direction of the coordinate axes depicted in the figures).

Figure 1A:
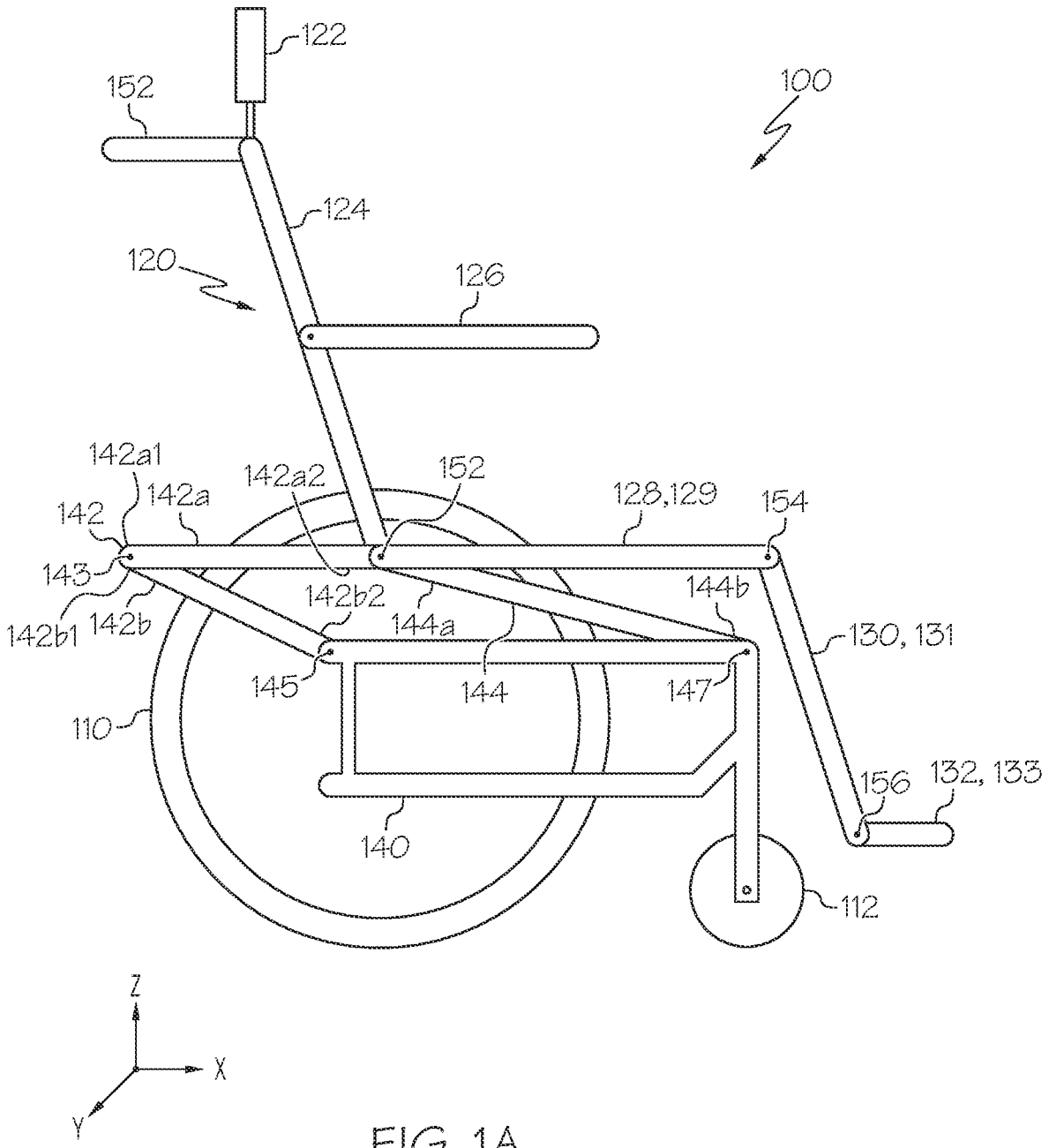
FIG. 1A schematically depicts a side view of an exoskeleton wheelchair system in accordance with one or more embodiments shown and described herein.
Figure 1B:
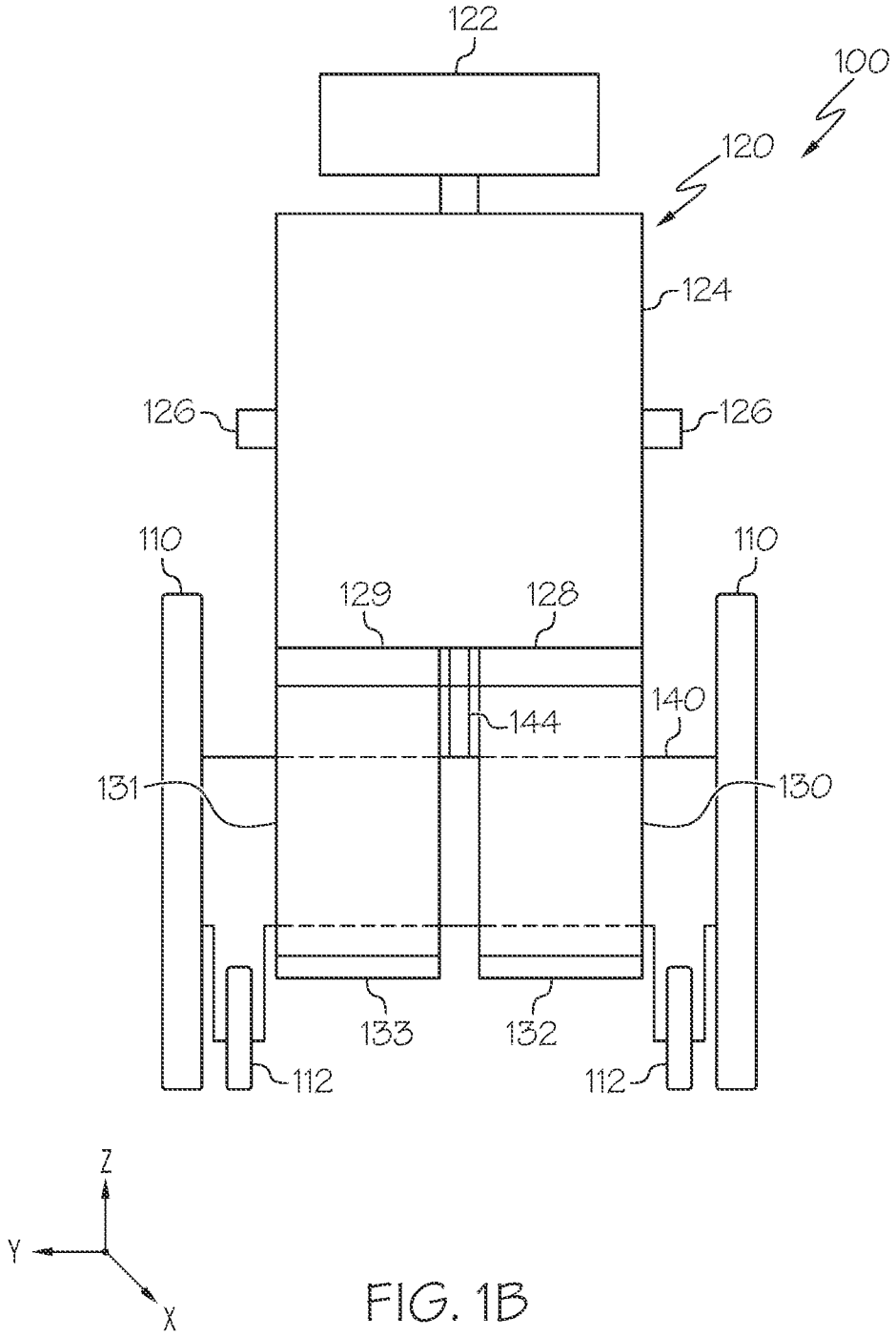
FIG. 1B schematically depicts a front view of an exoskeleton wheelchair system illustrated in FIG. 1A in accordance with one or more embodiments shown and described herein.
Figure 1C:
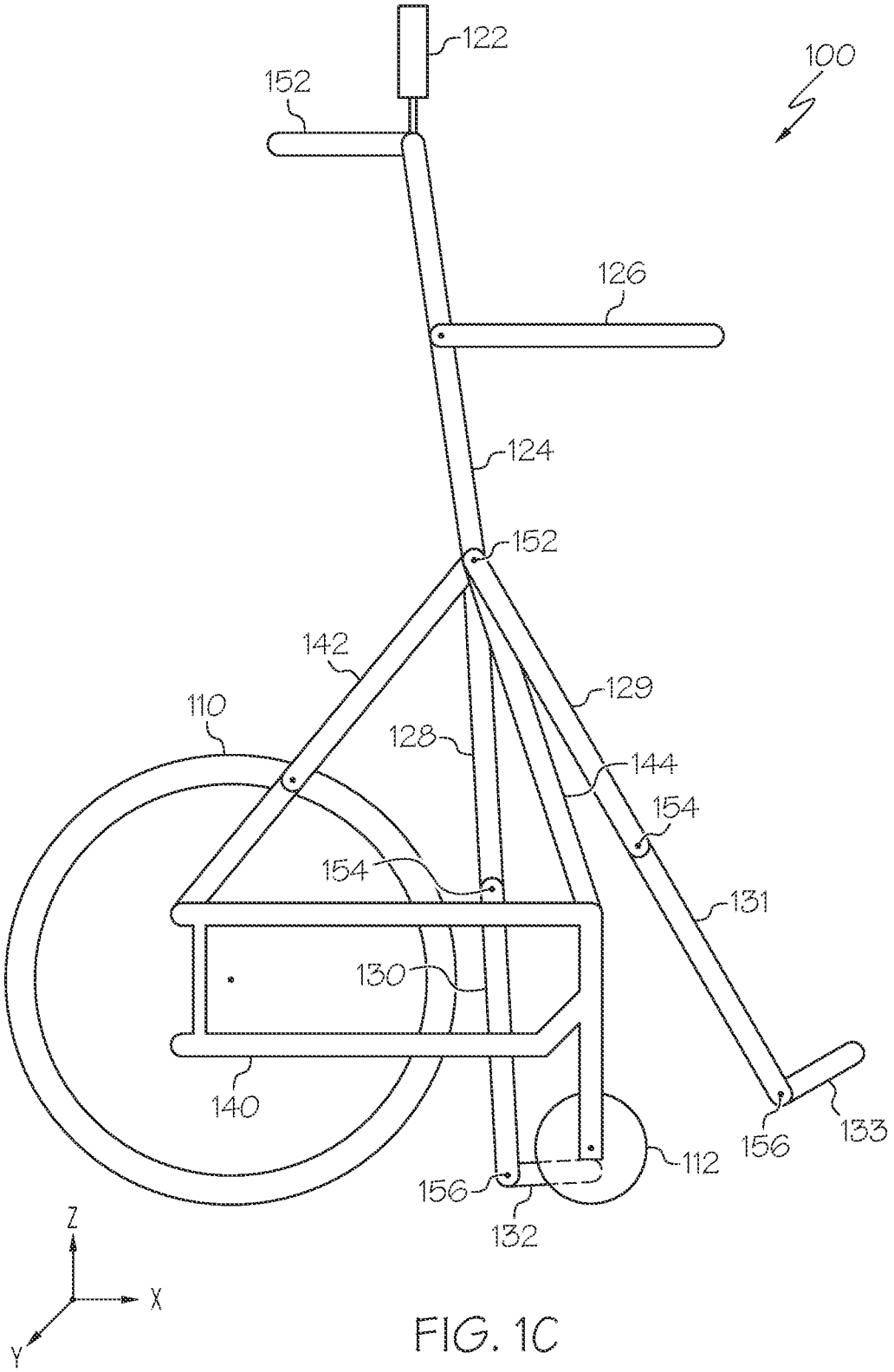
FIG. 1C schematically depicts an exoskeleton wheelchair system in a standing position mode in accordance with one or more embodiments shown and described herein.

Referring now to FIGS. 1A-1C, one embodiment of an exoskeleton wheelchair system is described. FIG. 1A depicts a side view of the exoskeleton wheelchair system 100. In FIG. 1A, the exoskeleton wheelchair system 100 is in a wheelchair position mode. The exoskeleton wheelchair system 100 includes a base 140, one or more front wheels 112 attached to the base 140, and one or more rear wheels 110 attached to the base 140. The exoskeleton wheelchair system 100 also includes a body support 120. The body support 120 includes a head support 122, a back support 124, a pair of armrests 126, a pair of upper leg supports 128 and 129, a pair of lower leg supports 130 and 131, and a pair of foot supports 132 and 133. In some embodiments, the body support 120 also includes one or more straps for fixing a user in the exoskeleton wheelchair system 100. For example, in some embodiments the back support 124 may include a strap for fixing the body of the user in the exoskeleton wheelchair system 100. In some embodiments, each of the pair of upper leg supports 128 and 129 may include a strap for fixing an upper leg of the user. In some embodiments, each of the pair of lower leg supports 130 may include a strap for fixing a lower leg of the user. In some embodiments, each of the pair of foot supports 132 and 133 may include a strap for fixing a foot of the user.

The pair of upper leg supports 128 and 129 are pivotally coupled to the back support 124 and are configured to pivotally rotate about a first axis 152. The pair of lower leg supports 130 and 131 are pivotally coupled to the upper leg supports 128 and 129 and are configured to pivotally rotate about a second axis 154. The pair of foot supports 132 and 133 are pivotally coupled to the lower leg supports 130 and 131 and are configured to pivotally rotate about a third axis 156.

The body support 120 is connected to the base 140 through a plurality of mode changing linkages 142 and 144. Although two mode changing linkages 142 and 144 are illustrated in FIG. 1A, more than two or less than two mode changing linkages may be used to connect the base 140 with the body support 120. For example, three or more mode changing linkages may be used to connect the base 140 with the body support 120, in some embodiments.

The mode changing linkage 142 includes an upper portion 142*a* and a lower portion 142*b*. As illustrated in FIG. 1A, one end 142*a*1 of the upper portion 142*a* of the mode changing linkage 142 is pivotally coupled to one end 142*b*1 of the lower portion 142*b* of the mode changing linkage and is configured to pivotally rotate about a linkage axis 143. The other end 142*a*2 of the upper portion 142*a* of the mode changing linkage 142 is pivotally coupled to the body support 120 and is configured to pivotally rotate about the first axis 152. The other end 142*b*2 of the lower portion 142*b* of the mode changing linkage 142 is pivotally coupled to the base 140 and is configured to pivotally rotate about a first base axis 145. One end 144*b* of the mode changing linkage 144 is pivotally coupled to the base 140 and is configured to pivotally rotate about a second base axis 147. The other end 144*a* of the mode changing linkage 144 is pivotally coupled to the body support 120 and is configured to pivotally rotate about the first axis 152.

FIG. 1B depicts a front view of the exoskeleton wheelchair system 100 illustrated in FIG. 1A. As shown in FIG. 1B, the exoskeleton wheelchair system 100 includes the base 140, one or more front wheels 112 attached to the base 140, and one or more rear wheels 110 attached to the base 140. A front view of the body support 120 is also shown in FIG. 1B. The body support 120 includes the head support 122, the back support 124, the pair of armrests 126, the pair of upper leg supports 128 and 129, the pair of lower leg supports 130 and 131, and the pair of foot supports 132 and 133.

FIG. 1C depicts the exoskeleton wheelchair system 100 in a standing position mode. In one embodiment, the mode changing linkages 142 and 144 in FIG. 1A may move in order to transit the body support 120 from the wheelchair position mode of FIG. 1A to the standing position mode as shown in FIG. 1C. When the exoskeleton wheelchair system 100 is in the standing position, the location of the back support 124 is higher in terms of the vertical direction than the location of the back support 124 in the wheelchair position mode depicted in FIG. 1A. The mode changing linkages 142 and 144 may be rotated by actuators, e.g., electronic motors (not shown in FIG. 1C). In other embodiments, different linkage bars or other mechanism may be used to move the body support 120 to the standing position. When the body support 120 switches to the standing position mode, the upper leg supports 128 and 129 and the lower leg supports 130 and 131 may be aligned such that the upper leg supports 128 and 129 are coplanar and parallel with the lower leg supports 130 and 131 as shown in FIG. 1C, such that a user sitting on the exoskeleton wheelchair system can extend his legs straight when the body support in the standing position mode.

In one embodiment, the pair of the upper leg supports 128 and 129 pivots about the first axis 152. For example, the pair of the upper leg supports 128 and 129 may move back and forth in conjunction with the legs of a user of the exoskeleton wheelchair system 100 moving back and forth. The first axis 152 is maintained at a fixed position relative to the location of the base 140 when one or more of the upper leg supports 128 and 129 pivot about the first axis 152 while the exoskeleton wheelchair system 100 is in the standing position mode. The back support 124 is also maintained at a fixed position relative to the location of the base 140 when one or more of the upper leg supports 128 and 129 pivot about the first axis 152 while the exoskeleton wheelchair system 100 is in the standing position mode. In some embodiments, the lower leg supports 130 and 131 may be parallel and coplanar with the upper leg supports 128 and 129 and move as the upper leg supports 128 and 129 pivot about the first axis. Various actuators may be used for pivoting the upper leg supports 128 and 129 and/or the lower leg supports 130 and 131, which will be described below with reference to FIGS. 2A, 3 and 4.

FIG. 2A depicts an exoskeleton wheelchair system 200 in a standing position mode in accordance with one or more embodiments shown and described herein. Similar to the exoskeleton wheelchair system 100 illustrated in FIG. 1C, the exoskeleton wheelchair system 200 includes the base 140, one or more front wheels 112 attached to the base 140, and one or more rear wheels 110 attached to the base 140. The exoskeleton wheelchair system 200 also includes the body support 120. The body support 120 includes the head support 122, the back support 124, the pair of armrests 126, the pair of upper leg supports 128 and 129, the pair of lower leg supports 130 and 131, and the pair of foot supports 132 and 133. The pair of upper leg supports 128 and 129 are pivotally coupled to the back support 124 and are configured to pivotally rotate about the first axis 152. The pair of lower leg supports 130 and 131 are pivotally coupled to the upper leg supports 128 and 129 and are configured to pivotally rotate about the second axis 154. The pair of foot supports 132 and 133 are pivotally coupled to the lower leg supports 130 and 131 and are configured to pivotally rotate about the third axis 156.

The exoskeleton wheelchair system 200 also includes an actuator 210. The actuator 210 may have a circular shape. The actuator 210 rotates about a central axis 216. The actuator 210 may include an internal electric motor and may be rotated by the internal electric motor in association with the rear wheels 110 or independent of the rear wheels 110. In another example, the actuator 210 may be rotated by an external electric motor that drives the exoskeleton wheelchair system 200 in the longitudinal direction (i.e., +/−x direction) by rotating the rear wheels 110 or the front wheels 112. The external electric motor may be mechanically coupled to the actuator and/or the rear wheels 110 and the front wheels 112. For example, the external electric motor may rotate both the rear wheels 110 and the actuator 210. The actuator 210 is linked to the pair of lower leg supports 130 and 131 via a linkage 212 and a linkage 214, respectively. One end 212*a*1 of the linkage 212 is pivotally coupled to a contour of the actuator 210 and is configured to pivotally rotate about a first contour axis 212*a*. One end 214*a*1 of the linkage 214 is pivotally coupled to a contour of the actuator 210 and is configured to pivotally rotate about a second contour axis 214*a*. For example, one end 212*a*1 of the linkage 212 is pivotally coupled at the top (in terms of the vertical direction) of the contour of the actuator 210 and is configured to pivotally rotate about a first contour axis 212*a* as shown in FIG. 2A, and one end 214*a*1 of the linkage 214 may be pivotally coupled at the rightmost (in terms of the longitudinal direction) of the counter of the actuator 210 and is configured to pivotally rotate about a second contour axis 214*a* as shown in FIG. 2A. In another example, one end 212*a*1 of the linkage 212 may be coupled at the top (in terms of the vertical direction) of the contour of the actuator 210 as shown in FIG. 2A, and one end 214*a*1 of the linkage 214 may be coupled at the bottom (in terms of the vertical direction) of the counter of the actuator 210. In another example, both one end 212*a*1 of the linkage 212 and one end 214*a*1 of the linkage 214 may be coupled at the same location on the contour of the actuator 210.

The other end 212*b*1 of the linkage 212 is pivotally coupled to the lower leg support 130 and is configured to pivotally rotate about a first lower leg axis 212*b*, as illustrated in FIG. 2A. The other end 214*b*1 of the linkage 214 is pivotally coupled to the lower leg support 131 and is configured to pivotally rotate about a second lower leg axis 214*b*, as illustrated in FIG. 2A. As the actuator 210 rotates about the central axis 216, the one end 212*a*1 of the linkage 212 proximate to the first contour axis 212*a* and the one end 214*a*1 of the linkage 214 proximate to the second contour axis 214*a* make a circular movement. As the one end 212*a*1 of the linkage 212 makes the circular movement, the other end 212*b*1 of the linkage 212 pivotally coupled to the lower leg support 130 either pushes or pulls the lower leg support 130 in the longitudinal direction. Similarly, as the one end 214*a*1 of the linkage 214 makes the circular movement, the other end 214*b*1 of the linkage pivotally coupled to the lower leg support 131 either pushes or pulls the lower leg support 130 in the longitudinal direction. In another embodiment, the actuator 210 is linked to the pair of the upper leg supports 128 and 129 through the linkage 212 and the linkage 214, respectively. One end 212*a*1 or 214*a*1 of each of the linkages 212 and 214 is pivotally coupled to a contour of the actuator, and the other end 212*b*1 or 214*b*1 of each of the linkages 212 and 214 is pivotally coupled to either the upper leg support 128 or the upper leg support 129 and are configured to pivotally rotate about an axis positioned on either the upper leg support 128 or the upper leg support 129. As the one end 212*a*1 or 214*a*1 of each of the linkages 212 and 214 makes the circular movement, each of the linkages 212 and 214 either pushes or pulls the upper leg supports 128 and 129.

Figure 2B:
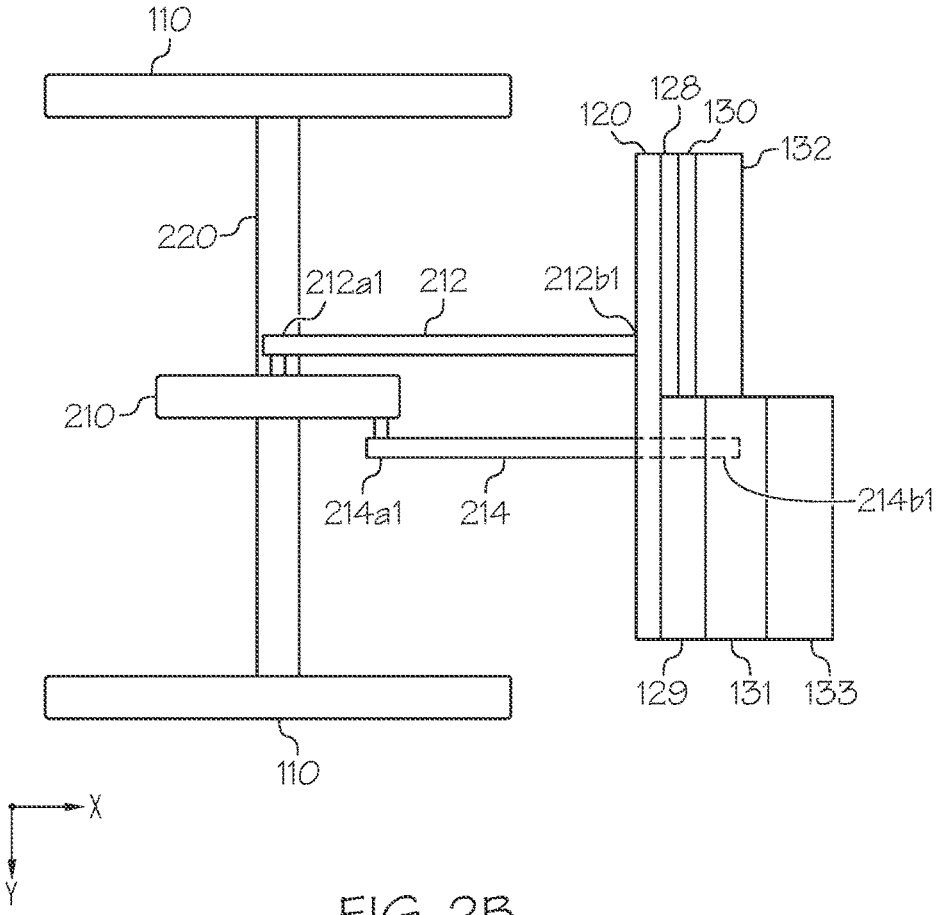
FIG. 2B schematically depicts a top partial view of the exoskeleton wheelchair system of FIG. 2A in accordance with one or more embodiments shown and described herein.

FIG. 2B schematically depicts a top partial view of the exoskeleton wheelchair system 200 of FIG. 2A. In one embodiment, the actuator 210 is linked with the rear wheels 110 through a wheel axis bar 220. When the rear wheels 110 are rotated by, e.g., an electric motor or human labor, the rotation torque from the rear wheels 110 is delivered to the actuator 210 through the wheel axis bar 220. The rotation of the rear wheels 110 is synchronized with the rotation of the actuator 210. In some embodiments, the actuator may be rotated by an electric motor independent of the rotation of the rear wheels 110. For example, the actuator 210 may be rotated while the rear wheels 110 do not rotate. As the actuator 210 rotates about the central axis 216 as shown in FIG. 2A, one end 212*a*1 or 214*a*1 of each of the linkages 212 and 214 rotates about the central axis 216. The one end 212*a*1 or 214*a*1 of each of the linkages 212 and 214 moves in the longitudinal direction (i.e., +/−x direction) in FIG. 2B, and thereby the other end 212*b*1 or 214*b*1 of each of the linkages 212 and 214 either pushes or pulls the lower leg supports 130 in the longitudinal direction. The lower leg supports 130 and 131 pivots about the first axis 152 shown in FIG. 2A in response to the push or pull of the lower leg supports 130 and 131. Accordingly, the exoskeleton wheelchair system allows a user sitting in the exoskeleton wheelchair system 200 to move his legs even when his legs are disabled, and thereby improves blood flow in the legs of the user.

Figure 2C:
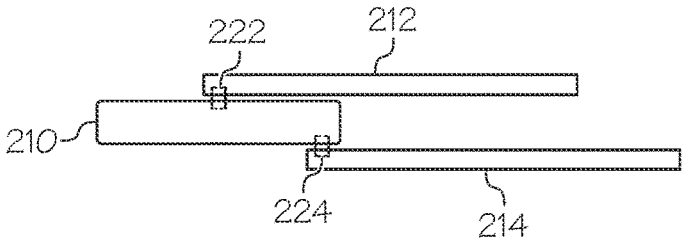
FIG. 2C schematically depicts engagement between an actuator and linkages in accordance with one or more embodiments shown and described herein.
Figure 2D:
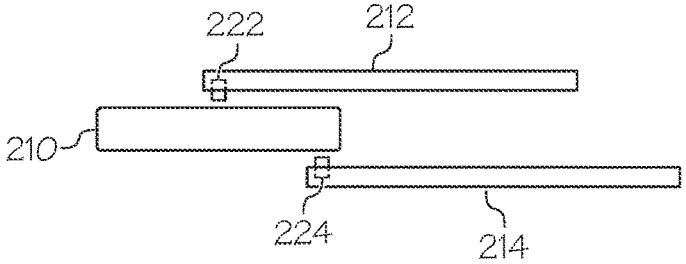
FIG. 2D schematically depicts disengagement between an actuator and linkages in accordance with one or more embodiments shown and described herein.

FIGS. 2C and 2D schematically depict engagement between the actuator 210 and the linkages 212 and 214. In FIG. 2C, the linkages 212 and 214 are engaged with the actuator 210 via coupling elements 222 and 224, respectively. The coupling element 222 is directly engaged with both the linkage 212 and the actuator 210. The coupling element 224 is directly engaged with both the linkage 214 and the actuator 210. When the linkages 212 and 214 are engaged with the actuator 210, one end 212*a*1 or 214*a*1 of the each of the linkages 212 and 214 rotates about the central axis 216 as the actuator 210 rotates. As one end 212*a*1 or 214*a*1 of the each of the linkages 212 and 214 rotates about the central axis 216, each of the linkages 212 and 214 either pushes or pulls the lower leg supports 130. In FIG. 2D, the linkages 212 and 214 are disengaged from the actuator 210 as the coupling elements 222 and 224 are detached from the actuator 210. In this embodiment, the rotation of the actuator 210 does not move the linkages 212 and 214. The linkages 212 and 214 may be moved by another actuator. By disengaging the linkages 212 and 214 from the actuator 210, the exoskeleton wheelchair system 200 allows a user to take a rest from exercising leg movements.

Figure 3:
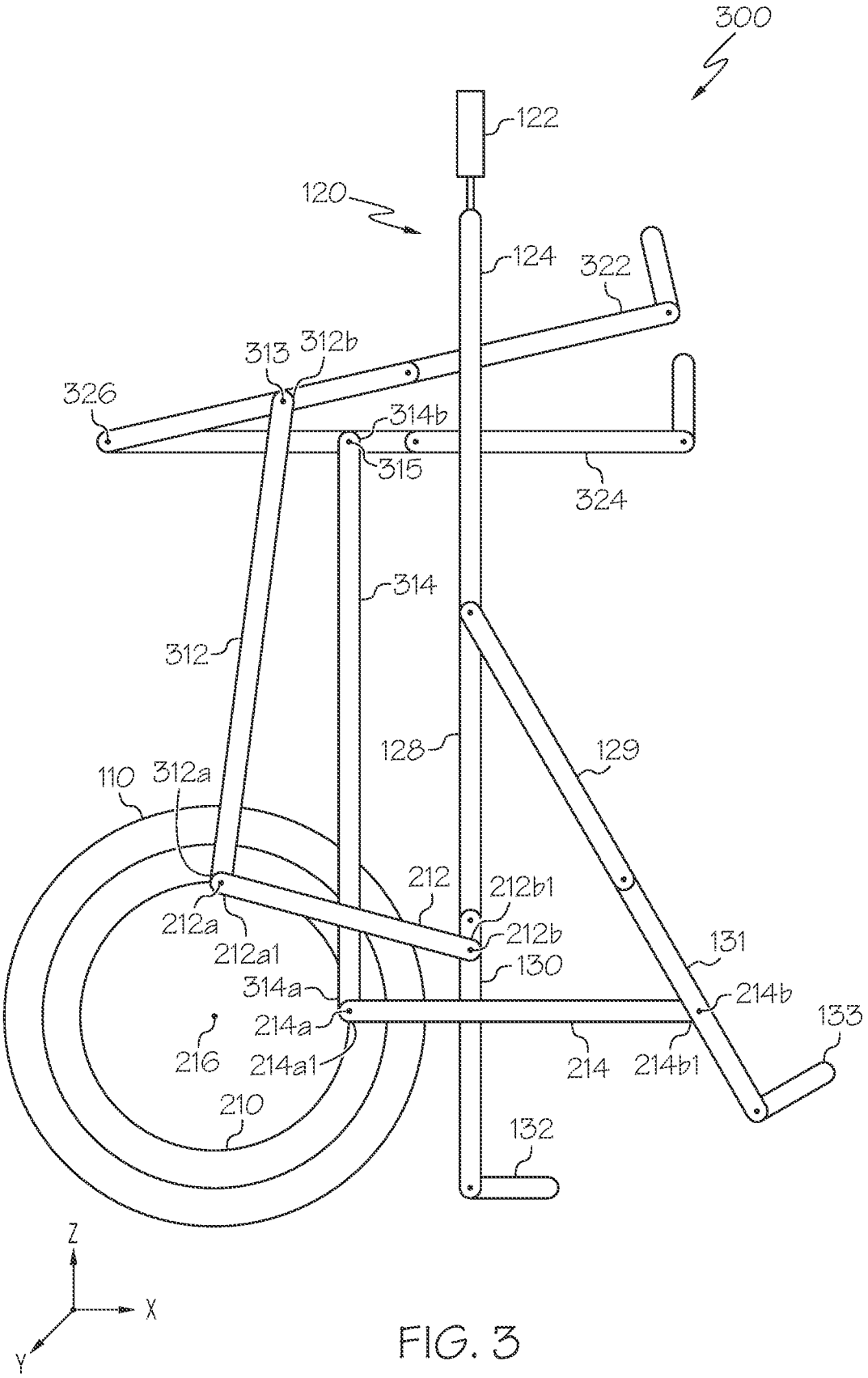
FIG. 3 schematically depicts an exoskeleton wheelchair system in accordance with one or more embodiments shown and described herein.

FIG. 3 schematically depicts an exoskeleton wheelchair system in accordance with one or more embodiments shown and described herein. Similar to the exoskeleton wheelchair system 200 illustrated in FIG. 2A, the exoskeleton wheelchair system 300 includes the body support 120. The body support 120 includes the head support 122, the back support 124, the pair of armrests 126, the pair of upper leg supports 128 and 129, the pair of lower leg supports 130 and 131, and the pair of foot supports 132 and 133. Other elements such as the base 140, front wheels 112 and the mode changing linkages 142 and 144 are omitted in FIG. 3 for better illustration of other elements.

As discussed with reference to FIG. 2A, the linkages 212 and 214 are connected between the actuator 210 and the lower leg supports 130 and 131. As the actuator 210 rotates about the central axis 216, each of the linkages 212 and 214 either pushes or pulls the lower leg supports 130 and 131, respectively. The exoskeleton wheelchair system 300 includes linkages 312 and 314 and armrests 322 and 324. The armrests 322 and 324 are coupled to each other at a point 326, and configured to pivotally rotate about the point 326. The point 326 is a fixed point of the exoskeleton wheelchair system 300.

One end 312*a* of the linkage 312 is pivotally coupled to a contour of the actuator 210 and configured to pivotally rotate about the first contour axis 212*a*. Similarly, one end 314*a* of the linkage 314 is pivotally coupled to a contour of the actuator 210 and configured to pivotally rotate about the second contour axis 214*a*. For example, one end 312*a* of the linkage 312 is coupled at the top (in terms of the vertical direction) of the contour of the actuator 210 as shown in FIG. 3, and one end 314*a* of the linkage 314 is coupled at the rightmost (in terms of the longitudinal direction) of the counter of the actuator 210 as shown in FIG. 3. In another example, one end 312*a* of the linkage 312 is coupled at the top (in terms of the vertical direction) of the contour of the actuator 210 as shown in FIG. 3, and one end 314*a* of the linkage 314 is coupled at the bottom (in terms of the vertical direction) of the counter of the actuator 210. In another example, both one end 312*a* of the linkage 312 and one end 314*a* of the linkage 314 is coupled at the same location on the contour of the actuator 210.

The other end 312*b* of the linkage 312 is pivotally coupled to the armrest 322, and configured to pivotally rotate about a first armrest axis 313, as illustrated in FIG. 3. Similarly, the other end 314*b* of the linkage 314 is pivotally coupled to the armrest 324, and configured to pivotally rotate about a second armrest axis 315, as illustrated in FIG. 3. As the actuator 210 rotates about the central axis 216, the one end 312*a* or 314*a* of each of the linkages 312 and 314 makes a circular movement. As the one end 312*a* or 314*a* of each of the linkages 312 and 314 makes the circular movement, each of the linkages 312 and 314 either pushes or pulls the armrests 322 and 324, respectively, in the vertical direction. In response to the push or pull, the armrests 322 and 324 rotate about the point 326. Accordingly, the exoskeleton wheelchair system 300 may facilitate movements of arms of a user sitting in the exoskeleton wheelchair system 300, and improve blood flow in the arms of the user.

In another embedment, a user in the exoskeleton wheelchair system 300 may move his arms to rotate the armrests 322 and 324 about the point 326. The rotations of the armrests 322 and 324 about the point 326 provides rotation torque to the actuator 210 through the linkages 312 and 314. The rotation torque rotates the actuator 210, which in turn, pushes or pulls the lower leg supports 130 and 131 via the linkages 212 and 214. In this embodiment, a user may manually move his legs by manipulating the armrests 322 and 324. Thus, the exoskeleton wheelchair system 300 may move the legs of a user sitting in the exoskeleton wheelchair system 300 without electric power.

Figure 4:
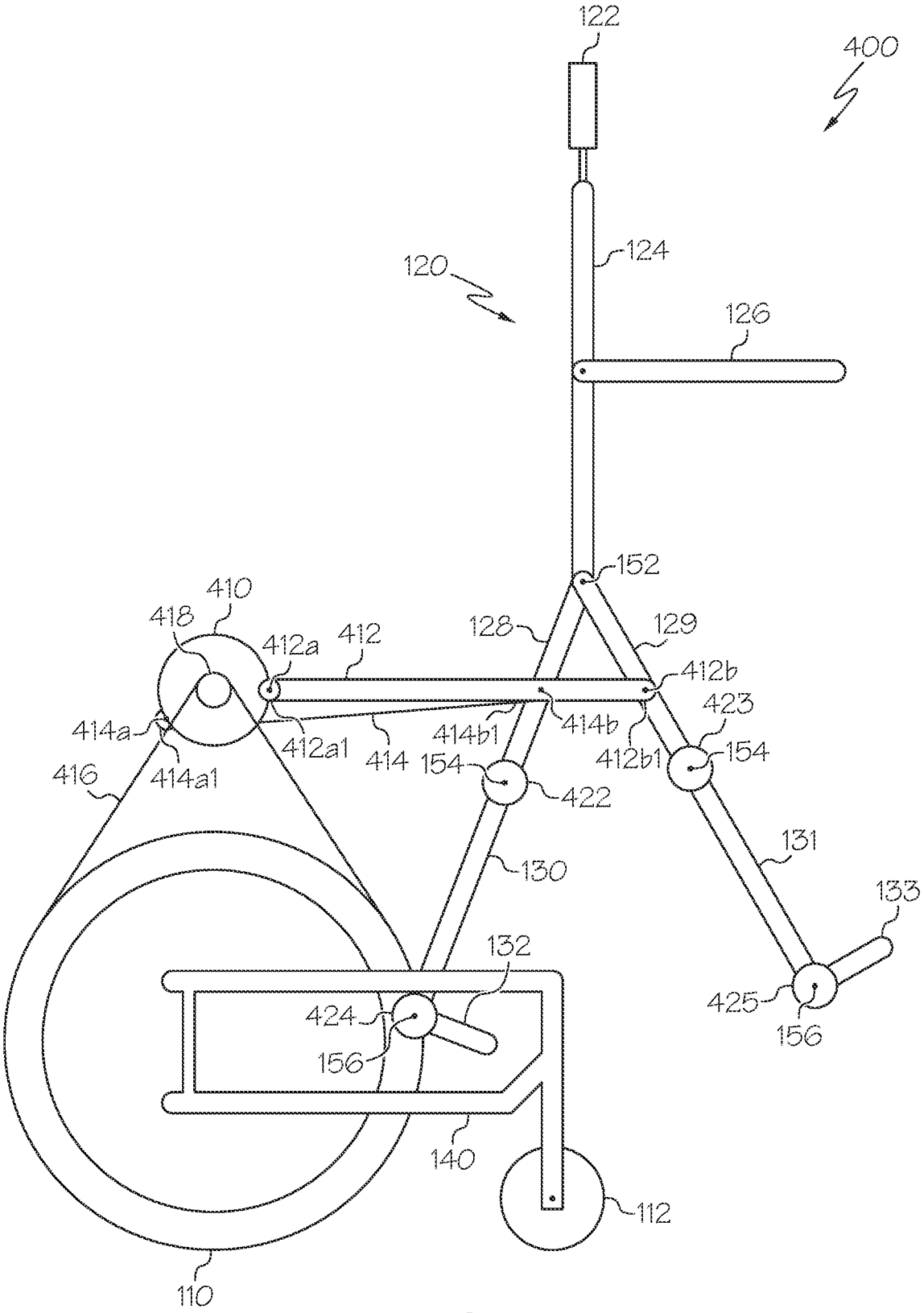
FIG. 4 schematically depicts an exoskeleton wheelchair system in accordance with one or more embodiments shown and described herein.

FIG. 4 schematically depicts an exoskeleton wheelchair system in accordance with one or more embodiments shown and described herein. Similar to the exoskeleton wheelchair system 200 illustrated in FIG. 2A, the exoskeleton wheelchair system 400 includes the body support 120. The body support 120 includes the head support 122, the back support 124, the pair of armrests 126, the pair of upper leg supports 128 and 129, the pair of lower leg supports 130 and 131, and the pair of foot supports 132 and 133. Other elements such as the mode changing linkages 142 and 144 are not depicted in FIG. 4 for better illustration of other elements.

The exoskeleton wheelchair system 400 includes a gait wheel 410, a belt 416, and linkages 412 and 414. The gait wheel 410 may be rotated by one or more of the rear wheels 110. For example, the gait wheel 410 has a shaft 418 and both the shaft 418 and the one or more of the rear wheels 110 are engaged with the belt 416. As the one or more of the rear wheels 110 rotate, the gait wheel 410 in turn rotates by the rotation torque provided by the belt 416. In some embodiments, any power transmission system other than the belt may be used to impart the rotation torque from the one or more of the rear wheels 110 to the gait wheel 410.

One end 412*a*1 of the linkage 412 is pivotally coupled to a contour of the gait wheel 410 and configured to pivotally rotate about a first gate wheel axis 412*a*. Similarly, one end 414*a*1 of the linkage 414 is pivotally coupled to a contour of the gait wheel 410 and configured to pivotally rotate about a second gate wheel axis 414*a*. For example, one end 412*a*1 of the linkage 412 is coupled at the right side (in terms of the longitudinal direction) of the contour of the gate wheel 410 as shown in FIG. 4, and one end 414*a*1 of the linkage 414 is coupled at the left side (in terms of the longitudinal direction) of the counter of the gait wheel 410 as shown in FIG. 4. In another example, one end 412*a*1 of the linkage 412 is coupled at the top (in terms of the vertical direction) of the contour of the gait wheel 410, and one end 414*a*1 of the linkage 414 is coupled at the right side (in terms of the longitudinal direction) of the counter of the gait wheel 410. In another example, both one end 412*a*1 of the linkage 412 and one end 414*a*1 of the linkage 414 is coupled at the same location on the contour of the gait wheel 410.

The other end 412*b*1 of the linkage 412 is pivotally coupled to the upper leg support 129 and configured to pivotally rotate about a first upper leg support axis 412*b*, as illustrated in FIG. 4. Similarly, the other end 414*b*1 of the linkage 414 is pivotally coupled to the upper leg support 128 and configured to pivotally rotate about a second upper leg support axis 414*b*, as illustrated in FIG. 4. As the gait wheel 410 rotates, the one end 412*a*1 or 414*a*1 of each of the linkages 412 and 414 makes a circular movement. As the one end 412*a*1 or 414*a*1 of each of the linkages 412 and 414 makes the circular movement, each of the linkages 412 and 414 either pushes or pulls the pair of upper leg supports 128 and 129, respectively, in the longitudinal direction. In response to the push or pull, the pair of upper leg supports 128 and 129 rotates about the first axis 152.

The exoskeleton wheelchair system 400 includes a pair of knee motors 422 and 423, and a pair of ankle motors 424 and 425. The pair of knee motors 422 and 423 are operated to rotate the lower leg supports 130 and 131 about the second axis 154, respectively such that a user in the exoskeleton wheelchair system 400 may bend or stretch his knees. The pair of ankle motors 424 and 425 are operated to rotate the foot supports 132 and 133 about the third axis 156, respectively such that a user in the exoskeleton wheelchair system 400 may bend or stretch his ankles.

Figure 5A:
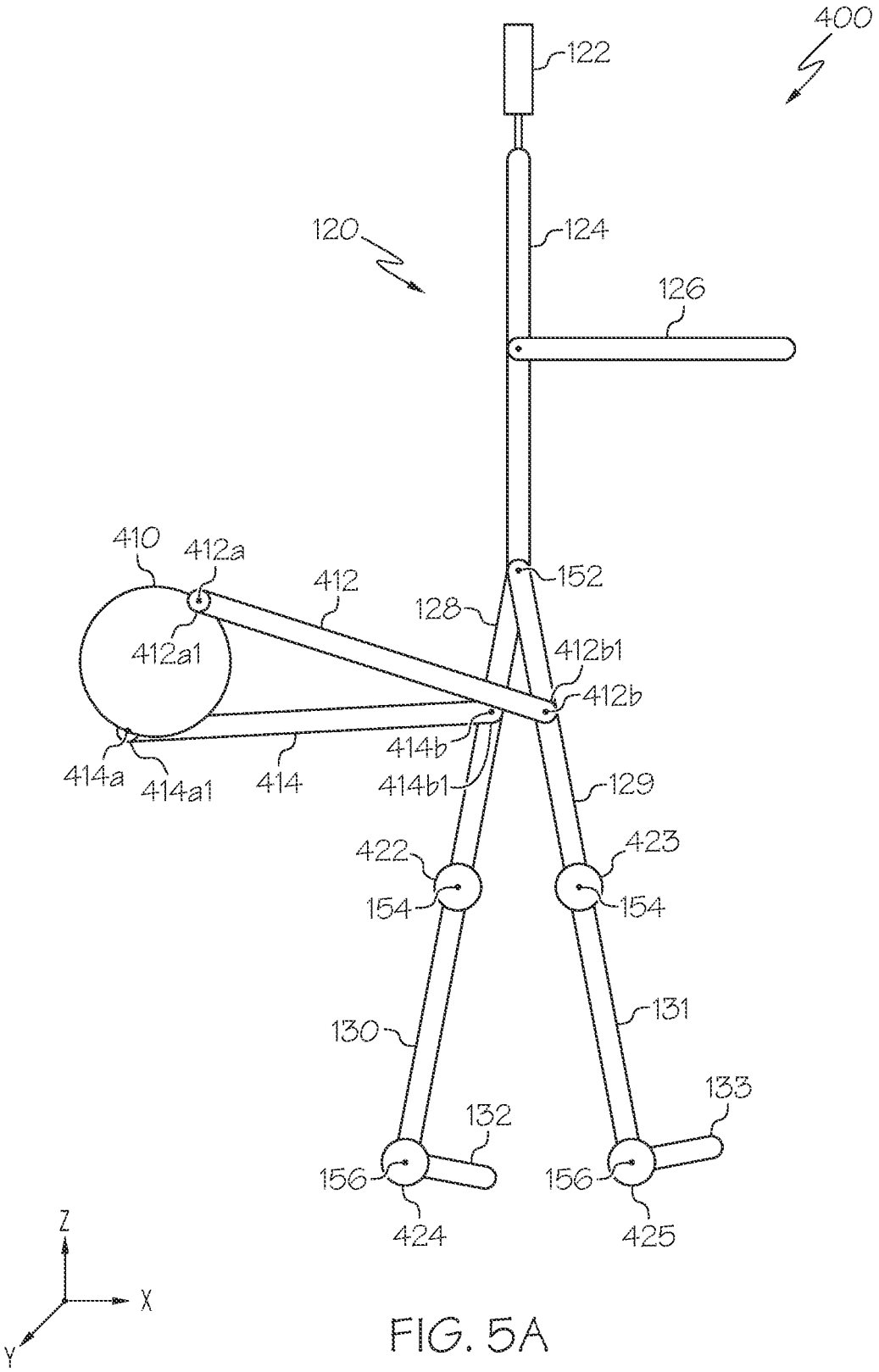
FIG. 5A schematically depicts an exoskeleton wheelchair system in a stand-by mode in accordance with one or more embodiments shown and described herein.
Figure 5B:
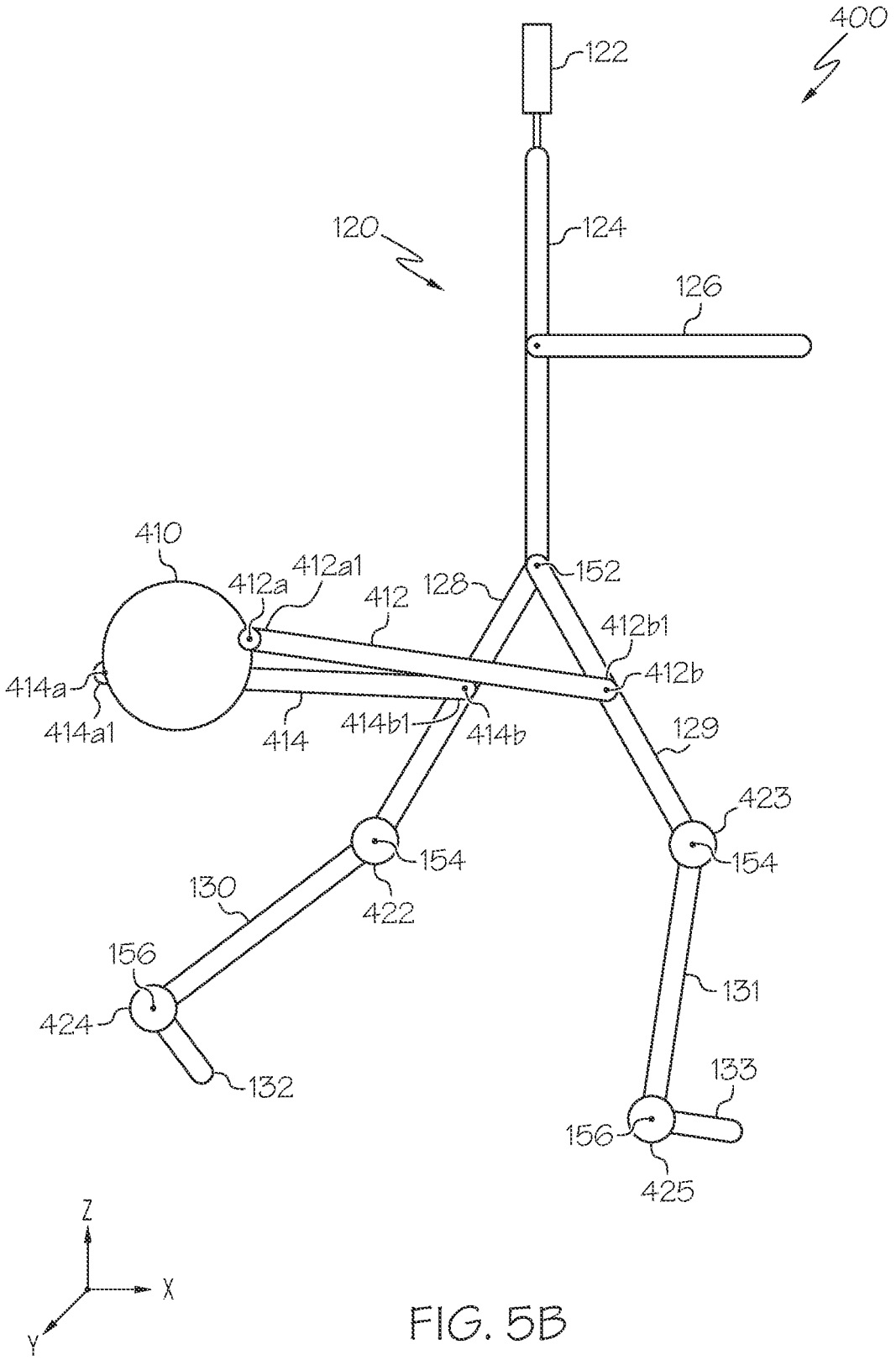
FIG. 5B schematically depicts an exoskeleton wheelchair system in a walking mode in accordance with one or more embodiments shown and described herein.

FIGS. 5A and 5B depict movement of the body support 120 in the exoskeleton wheelchair system 400 in accordance with one or more embodiments shown and described herein. In FIG. 5A, the body support 120 is in a standby mode where the gait wheel 410 does not rotate. In the standby mode, the upper leg supports 128 and 129 and the lower leg supports 130 and 131 may be parallel and coplanar as shown in FIG. 5A such that a user in the exoskeleton wheelchair system 400 may extend his legs straight. In another example, one end 412*a*1 of the linkage 412 is coupled at the top (in terms of the vertical direction) of the contour of the gait wheel 410, and one end 414*a*1 of the linkage 414 is coupled at the bottom (in terms of the vertical direction) of the counter of the gait wheel 410. In this example, the pair of upper leg supports 128 and 129 may be aligned in parallel.

In FIG. 5B, the body support 120 is in a walking mode where the gait wheel 410 rotates. As discussed with reference to FIG. 4, when the gait wheel 410 rotates, each of the linkages 412 and 414 either pushes or pulls the pair of upper leg supports 128 and 129, respectively, in the longitudinal direction. In response to the push or pull, the pair of upper leg supports 128 and 129 rotate about the first axis 152.

In response to the rotation of the gait wheel 410, the pair of knee motors 422 and 423 and the pair of ankle motors 424 and 425 also rotate. For example, the pair of knee motors 422 and 423 rotate the lower leg supports 130 and 131 about the second axis 154 such that a user in the exoskeleton wheelchair system 400 bends or stretches his knees simulating bending or stretching movements of the knees when he walks on the ground. The rotation of the lower leg supports 130 and 131 may be limited to a predetermined range. For example, the lower leg support 130 does not rotate counter-clockwise about the second axis 154 when the lower leg support 130 is aligned with the upper leg support 128 in order to prevent any harm to the knee joint of a user. In addition, the lower leg supports 130 and 131 may bend up to a certain degree, for example, about 90 degrees from its original position where the upper leg supports 128 and 129 are aligned with the lower leg supports 130 and 131, respectively.

The pair of ankle motors 424 and 425 rotate the pair of foot supports 132 and 133 about the third axis 156 such that a user in the exoskeleton wheelchair system 400 bends or stretches his ankles simulating bend or stretch movements of the ankles when he walks on the ground. The rotation of the foot supports 132 and 133 may be limited to a predetermined range. For example, the foot supports 132 and 133 rotate clockwise or counterclockwise about the third axis 156 up to about 20 degrees from its original position where the lower leg supports 130 and 131 are perpendicular to the foot supports 132 and 133, respectively.

Accordingly, the exoskeleton wheelchair system 400 may allow a user sitting in the exoskeleton wheelchair system 400 to move his legs even when his legs are disabled, and improve blood flow in the legs. In addition, the exoskeleton wheelchair system 400 may help the user sitting in the exoskeleton wheelchair system 400 to learn how to walk on the ground naturally.

Figure 6:
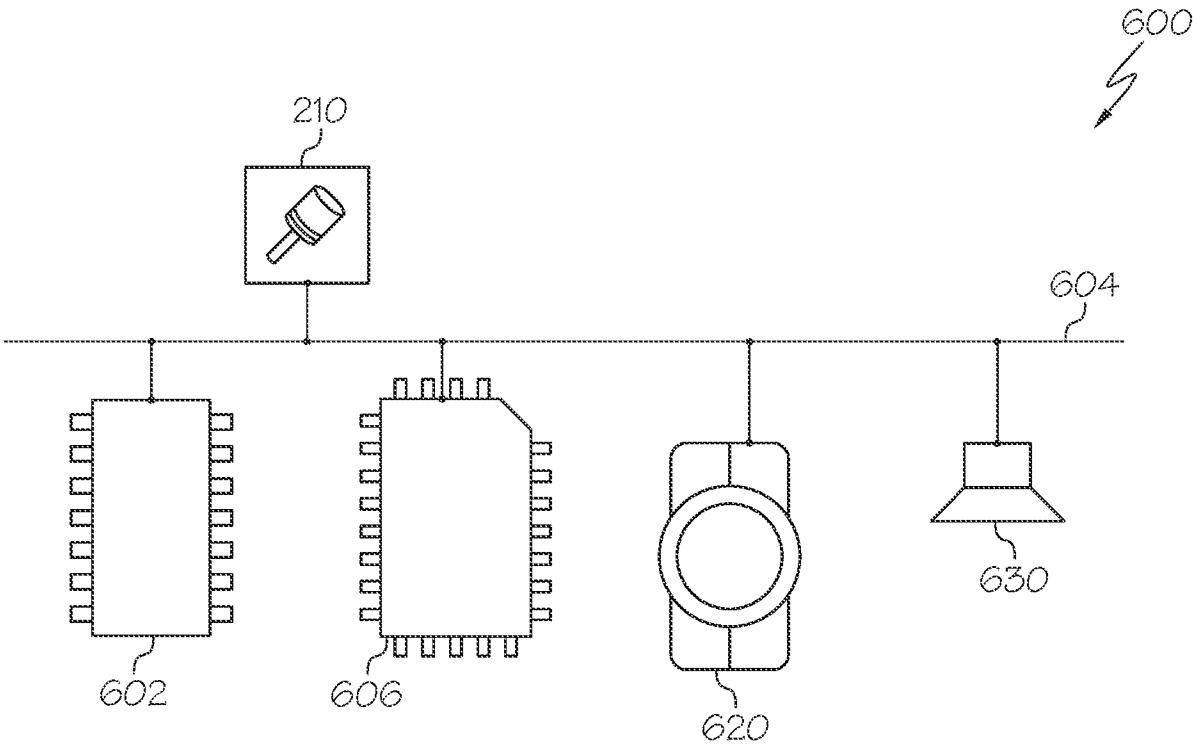
FIG. 6 schematically depicts an exoskeleton wheelchair system in accordance with one or more embodiments shown and described herein.

Referring now to FIG. 6, an embodiment of an exoskeleton wheelchair system 600 is schematically depicted. It is noted that, while the exoskeleton wheelchair system 600 is depicted in isolation, the exoskeleton wheelchair system 600 may be included within a wheelchair. The exoskeleton wheelchair system 600 includes one or more processors 602. Each of the one or more processors 602 may be any device capable of executing machine readable instructions. For example, each of the one or more processors 602 may be a controller, an integrated circuit, a microchip, a computer, or any other computing device. The one or more processors 602 are coupled to a communication path 604 that provides signal interconnectivity between various modules of the system. Accordingly, the communication path 604 may communicatively couple any number of processors 602 with one another, and allow the modules coupled to the communication path 604 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

Accordingly, it should be understood that the communication path 604 may be formed from any medium that is capable of transmitting a signal such as, for example, conductive wires, conductive traces, optical waveguides, or the like. In some embodiments, the communication path 604 may facilitate the transmission of wireless signals, such as WiFi, Bluetooth, Near Field Communication (NFC) and the like. Moreover, the communication path 604 may be formed from a combination of mediums capable of transmitting signals. In one embodiment, the communication path 604 comprises a combination of conductive traces, conductive wires, connectors, and buses that cooperate to permit the transmission of electrical data signals to components such as processors, memories, sensors, input devices, output devices, and communication devices. In embodiments, the communication path 604 may comprise a vehicle bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The exoskeleton wheelchair system 600 further includes one or more memory modules 606 coupled to the communication path 604. The one or more memory modules 606 may comprise RAM, ROM, flash memories, hard drives, or any device capable of storing machine readable instructions such that the machine readable instructions can be accessed by the one or more processors 602. The one or more memory modules 606 may be non-transient memory modules. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the one or more memory modules 606. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

In some embodiments, the one or more memory modules 606 may include a database that includes information on operating parameters for the gait wheel 410. For example, the database may include a rotation speed for the gait wheel 410. The one or more memory modules 606 store machine readable instructions that, when executed by the processor, cause the one or more processors 602 to rotate at least one of the upper leg supports 128 and 129 and the lower leg supports 130 and 131.

Referring still to FIG. 6, the exoskeleton wheelchair system 600 further includes the actuator 210. The actuator 210 is coupled to the communication path 604 and communicatively coupled to the one or more processors 602. The actuator 210 may be an electric motor for rotating the rear wheels 110, the front wheels 112, or the gait wheel 410. For example, the actuator 210 may be mechanically coupled to the rear wheels 110 and rotate the rear wheels 110. The actuator 210 may be also mechanically coupled to the gait wheel 410 shown in FIG. 4 and rotate the gait wheel 410.

Referring still to FIG. 6, the exoskeleton wheelchair system 600 further includes tactile input hardware 620 coupled to the communication path 604 such that the communication path 604 communicatively couples the tactile input hardware 620 to other modules of the exoskeleton wheelchair system 600. The tactile input hardware 620 may be any device capable of transforming mechanical, optical, or electrical signals into a data signal capable of being transmitted with the communication path 604. Specifically, the tactile input hardware 620 may include any number of movable objects that each transforms physical motion into a data signal that can be transmitted over the communication path 604 such as, for example, a button, a switch, a knob, a microphone or the like. For example, the tactile input hardware 620 may include buttons for controlling the rotation speed of the gate wheel 410.

The exoskeleton wheelchair system 600 further includes a speaker 630 coupled to the communication path 604 such that the communication path 604 communicatively couples the speaker 630 to other modules of the exoskeleton wheelchair system 600. The speaker 630 transforms data signals from the exoskeleton wheelchair system 600 into audible mechanical vibrations. The speaker 630 may provide information to an occupant of the exoskeleton wheelchair system 600 about the mode of the exoskeleton wheelchair system 600. For example, the speaker 630 may provide an alarm to the occupant when the exoskeleton wheelchair system 600 changes its mode from the wheelchair position mode to the standing position mode. In another example, the speaker 630 may provide an alarm to the occupant when the exoskeleton wheelchair system 600 is in the walking mode by rotating the gait wheel 410. The speaker 630 may provide different kinds of alarms depending on the operation modes of the exoskeleton wheelchair system 600.

Figure 7:
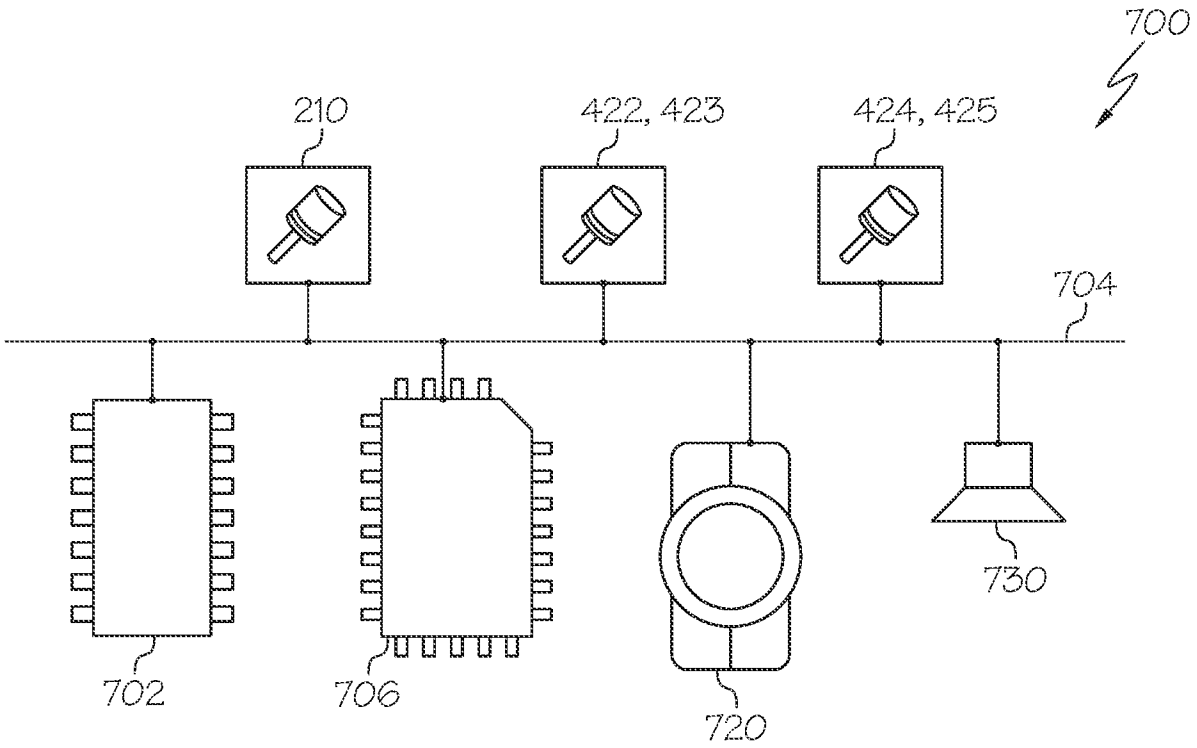
FIG. 7 schematically depicts an exoskeleton wheelchair system in accordance with one or more embodiments shown and described herein.

Referring now to FIG. 7, an embodiment of an exoskeleton wheelchair system 700 is schematically depicted. It is noted that, while the exoskeleton wheelchair system 700 is depicted in isolation, the exoskeleton wheelchair system 700 may be included within a wheelchair. The exoskeleton wheelchair system 700 includes one or more processors 702. Each of the one or more processors 702 may be any device capable of executing machine readable instructions. For example, each of the one or more processors 702 may be a controller, an integrated circuit, a microchip, a computer, or any other computing device. The one or more processors 702 are coupled to a communication path 704 that provides signal interconnectivity between various modules of the system. Accordingly, the communication path 704 may communicatively couple any number of processors 702 with one another, and allow the modules coupled to the communication path 704 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

Accordingly, it should be understood that the communication path 704 may be formed from any medium that is capable of transmitting a signal such as, for example, conductive wires, conductive traces, optical waveguides, or the like. In some embodiments, the communication path 704 may facilitate the transmission of wireless signals, such as WiFi, Bluetooth, Near Field Communication (NFC) and the like. Moreover, the communication path 704 may be formed from a combination of mediums capable of transmitting signals. In one embodiment, the communication path 704 comprises a combination of conductive traces, conductive wires, connectors, and buses that cooperate to permit the transmission of electrical data signals to components such as processors, memories, sensors, input devices, output devices, and communication devices. In embodiments, the communication path 704 may comprise a vehicle bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The exoskeleton wheelchair system 700 further includes one or more memory modules 706 coupled to the communication path 704. The one or more memory modules 706 may comprise RAM, ROM, flash memories, hard drives, or any device capable of storing machine readable instructions such that the machine readable instructions can be accessed by the one or more processors 702. The one or more memory modules 706 may be non-transient memory modules. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the one or more memory modules 706. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

In some embodiments, the one or more memory modules 706 may include a database that includes information on operating parameters for the gait wheel 410, the pair of knee motors 422 and 423 and the pair of ankle motors 424 and 425. For example, the database may include a rotation speed for the gait wheel 410, a rotation speed and/or a rotation angle for the pair of knee motors 422 and 423, and a rotation speed and/or a rotation angle for the pair of ankle motors 424 and 425. The one or more memory modules 606 store machine readable instructions that, when executed by the processor, cause the one or more processors 702 to rotate at least one of the upper leg supports 128 and 129 and the lower leg supports 130 and 131.

Referring still to FIG. 7, the exoskeleton wheelchair system 700 further includes the actuator 210. The actuator 210 is coupled to the communication path 704 and communicatively coupled to the one or more processors 702. The actuator 210 may be an electric motor for rotating the rear wheels 110, the front wheels 112, or the gait wheel 410. For example, the actuator 210 may be mechanically coupled to the rear wheels 110 and rotate the rear wheels 110. The actuator 210 may be also mechanically coupled to the gait wheel 410 shown in FIG. 4 and rotate the gait wheel 410.

Referring still to FIG. 7, the exoskeleton wheelchair system 600 further includes the pair of knee motors 422 and 423. Each of the knee motors 422 and 423 is coupled to the communication path 704 and communicatively coupled to the one or more processors 702. The one or more processors 702 may control the rotation speed and the rotation angle of the pair of knee motors 422 and 423 based on predetermined operation parameters stored in the one or more memory modules 706. In some embodiments, the one or more processors 702 may control the rotation speed and the rotation angle of the pair of knee motors 422 and 423 in response to signals from a tactile input hardware 720.

Referring still to FIG. 7, the exoskeleton wheelchair system 700 further includes the pair of ankle motors 424 and 425. Each of the ankle motors 424 and 425 is coupled to the communication path 704 and communicatively coupled to the one or more processors 702. The one or more processors 702 may control the rotation speed and the rotation angle of the pair of ankle motors 424 and 425 based on predetermined operation parameters stored in the one or more memory modules 706. In some embodiments, the one or more processors 702 may control the rotation speed and the rotation angle of the pair of ankle motors 424 and 425 in response to signals from a tactile input hardware 720.

Referring still to FIG. 7, the exoskeleton wheelchair system 700 further includes tactile input hardware 720 coupled to the communication path 704 such that the communication path 704 communicatively couples the tactile input hardware 720 to other modules of the exoskeleton wheelchair system 700. The tactile input hardware 720 may be any device capable of transforming mechanical, optical, or electrical signals into a data signal capable of being transmitted with the communication path 704. Specifically, the tactile input hardware 720 may include any number of movable objects that each transforms physical motion into a data signal that can be transmitted over the communication path 704 such as, for example, a button, a switch, a knob, a microphone or the like. For example, the tactile input hardware 720 may include buttons for controlling the rotation speed of the gait wheel 410. The tactile input hardware 720 may also include buttons for controlling the rotation speed and or rotation angle of the pair of knee motors 422 and 423 and/or the pair of ankle motors 424 and 425.

The exoskeleton wheelchair system 700 further includes a speaker 730 coupled to the communication path 704 such that the communication path 704 communicatively couples the speaker 730 to other modules of the exoskeleton wheelchair system 700. The speaker 730 transforms data signals from the exoskeleton wheelchair system 700 into audible mechanical vibrations. The speaker 730 may provide information to an occupant of the exoskeleton wheelchair system 700 about the mode of the exoskeleton wheelchair system 700. For example, the speaker 730 may provide an alarm to the occupant when the exoskeleton wheelchair system 700 changes its mode from the wheelchair position mode to the standing position mode. In another example, the speaker 730 may provide an alarm to the occupant when the exoskeleton wheelchair system 700 is in the walking mode by rotating the gait wheel 410. The speaker 730 may provide different kinds of alarms depending on the operation modes of the exoskeleton wheelchair system 700.

It should be understood that embodiments described herein are directed to exoskeleton wheelchair systems including leg supports which can pivot while the exoskeleton wheelchair systems are in a standing mode. An exoskeleton wheelchair system may include a base, one or more drive wheels coupled to the base, and a body support connected to the base. The body support may be switched between a wheelchair position mode and a standing position mode. The body support includes a back support, and one or more leg supports pivotally coupled to the back support about a first axis. The one or more leg supports are configured to pivot about the first axis while the body support is in the standing position mode in response to a rotation of an actuator. By allowing the one or more leg supports to pivot while in the standing position mode, a user sitting in the exoskeleton wheelchair system can move his legs even when his legs are disabled, which improves blood flow in the legs. In addition, the exoskeleton wheelchair system 400 may help the user sitting in the exoskeleton wheelchair system 400 to learn how to walk on the ground naturally It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An exoskeleton wheelchair system, comprising:

a base;

one or more wheels coupled to the base;

a body support connected to the base, comprising:

a back support; and one or more leg supports pivotally coupled to the back support; and a gait wheel linked with the one or more leg supports via one or more gait linkages and configured to rotate in association with the one or more wheels, wherein the one or more leg supports are configured to pivot about a first axis when the back support is in a standing position mode, the back support is maintained at a fixed position relative to a location of the base when the one or more leg supports pivot about the first axis while the back support is in the standing position mode, and one end of each of the one or more gait linkages is pivotally connected to a contour of the gait wheel.

2. The exoskeleton wheelchair system of claim 1, wherein the gait wheel is linked with the one or more wheels, and is rotated in response to a rotation of the one or more wheels.

3. The exoskeleton wheelchair system of claim 1, further comprising:

a processor;

a memory module; and machine readable instructions stored in the memory module that, when executed by the processor, cause the processor to control rotation of the gait wheel.

4. The exoskeleton wheelchair system of claim 1, wherein the one or more gait linkages are configured to push or pull the one or more leg supports to rotate the one or more leg supports about the first axis in response to the rotation of the gait wheel.

5. The exoskeleton wheelchair system of claim 1, wherein each of the one or more leg supports comprise:

an upper leg support pivotally coupled to the back support and configured to pivotally rotate about the first axis;

a lower leg support pivotally coupled to the upper leg support and configured to pivotally rotate about a second axis; and a foot support pivotally coupled to the lower leg support and configured to pivotally rotate about a third axis.

6. The exoskeleton wheelchair system of claim 5, wherein each of the one or more leg supports further comprises:

a first actuator configured to rotate the lower leg support about the second axis;

a second actuator configured to rotate the foot support about the third axis; and a controller programmed to:

control the first actuator to rotate the lower leg support about the second axis within a first predetermined range; and control the second actuator to rotate the foot support about the third axis within a second predetermined range.

* * * * *